United States Patent [19]

Tone

[11] 4,031,846

[45] June 28, 1977

[54] ANTI-CAVITATION SHROUD AND RUDDER

[76] Inventor: John W. Tone, 2601 Foulk Road, Wilmington, Del. 19810

[22] Filed: Oct. 9, 1975

[21] Appl. No.: 620,939

[52] U.S. Cl. ..... 115/39; 114/163; 115/35

[51] Int. Cl.[2] ..... B63H 5/16

[58] Field of Search ..... 114/162, 163, 66.5 P; 115/12 R, 34 R, 18 B, 35, 42, 39

[56] References Cited

UNITED STATES PATENTS

| | | | |
|---|---|---|---|
| 904,313 | 11/1908 | Davis | 115/35 |
| 3,611,973 | 10/1971 | Stuart | 114/162 |
| 3,742,895 | 7/1973 | Horiuchi | 115/34 R |
| 3,828,713 | 8/1974 | Duryea | 114/163 |

FOREIGN PATENTS OR APPLICATIONS

| | | | |
|---|---|---|---|
| 941,444 | 11/1963 | United Kingdom | 115/42 |

*Primary Examiner*—Trygve M. Blix
*Assistant Examiner*—Gregory W. O'Connor
*Attorney, Agent, or Firm*—Charles A. Weigel, Jr.

[57] ABSTRACT

An anti-cavitation semi-cylindrical shroud and rudder combination is described which attaches to the transom of a boat so as to partly enclose a propeller which extends rearwardly of the boat. The axis of the propeller is selected to provide a line of thrust which intersects the approximate center of hull resistance to provide more stable running characteristics. The shroud itself encompasses about 37% of the periphery of the propeller and the lower edges of its side skirt portions lie in a plane which is parallel to the keel of the boat. The configuration of the shroud is such that it conforms to the bottom hull configuration at the front end and shrouds the propeller at the rear end. The shroud itself is configured to provide minimal flow resistance to the water.

Yoke-mounted flanking rudders are pivoted ahead of the center of area of the rudder with the center of area of the rudders lying approximately in the fore and aft plane of the propeller. This facilitates turning particularly at low speeds. Finally, a planing plate extends rearwardly of the shroud and is configured to the contour of the shroud such that it may be pivoted in a vertical plane to change the attack angle of the water flowing from the propeller.

19 Claims, 9 Drawing Figures

Center of Wind Resistance-16
Sheer
Line of Thrust
Chine
Keel
Planing Angle 26
Vertical Center of Wetted Resistance-18
Rudder Pivot
Surface of Water;
Displaced Water Returning To The Surface @ Hull ℄
Total Running Draft
Dead Rise Angle
Horse Power
Speed M.P.H.
Planing Speed
HP∝V²
HP∝V³

ANTI-CAVITATION SHROUD AND RUDDER

BACKGROUND OF THE INVENTION

This invention relates to a marine drive which reduces cavitation of the propeller and permits a more shallow draft boat construction, and, more particularly, to a shroud and flanking rudder for use with power boats.

There have been literally hundreds of designs of boats attempting to improve the efficiency of boat propulsion and steering systems. Among these designs have been various tunnel hull configurations such as those described in U.S. Pat. Nos. 3,626,894; 2,896,565; or 3,793,980. While these tunnel designs have met with some degree of success they unfortunately offer a relatively expensive form of construction for the boat as well as occupy an undesired amount of space within the boat itself.

Other configurations have used out drives in which the motor drive shaft powers a propeller through a submerged gear box. This configuration permits good steering control but has the disadvantage of having a high degree of drag and requires the presence of a complex, expensive, sealed gear box, which itself is subject to leakage.

Often, the line of thrust provided by a propeller does not coincide with the center of hull resistance. This in itself can cause or produce unstable riding characteristics of the boat and, too, a portion of the forward thrust of the boat is lost, the loss being proportional to the cosine of the angle of which the line of thrust differs from the direction of motion.

Among all of these problems, however, cavitation of the propeller is perhaps one of the most troublesome. Cavitation is that effect produced by a propeller, particularly if it is not entirely submerged, to develop air pockets about the blades so that the blade has no solid surface of fluid to push against. At low speeds particularly, there is insufficient forward motion of the boat to permit a following propeller blade to meet solid water. Instead it tends to follow in the path of the preceding blade only to face an air pocket or cavity produced by the preceding blade. At higher speed air tends to be sucked into the propeller from the surface.

A planing boat acts as a displacement vessel. At low speeds, the horsepower required to drive the boat at a given speed is approximately a function of the cube of the boat velocity. With the higher angle of attack, under these conditions, i.e., the angle with which the boat approaches the surface of the water, the propeller is normally fully immersed. However, even with this full immersion cavitation can develop thereby reducing the effective thrust of the propeller. As the boat increases in speed, a point is reached at which the planing effect takes over and the dynamic effect of the water on the hull tends to lift the boat out of the water to assume a lower attack angle with greatly decreased drag. At this point, the horsepower required to drive the boat is reduced and normally varies as a function of the square of the boat velocity. With the boat now higher in the water, a real problem develops with cavitation of the propeller if a shallow draft of the boat is to be maintained for reduced drag, the propeller must be relatively close to the surface of the water without cavitating. Being close to the surface cavitation occurs all the more easily.

Accordingly, it is an object of this invention to provide an improved shroud for a boat propeller which reduces cavitation of the propeller.

A further object of this invention is to provide an improved shroud for a boat propeller which reduces cavitation of the propeller even when the propeller is close to the surface.

Many of the rudders designed for boats are of a type which are positioned immediately aft of the propeller itself so as to be in the helical wash of the propeller. This often creates a problem in that the turbulent flow from the propeller produces a much higher degree of drag on the rudder than would otherwise be desirable. To alleviate this problem, so-called flanking rudders have been designed. Unfortunately, most of the known type flanking rudders such as described in U.S. Pat. Nos. 3,710,794 and 3,872,817 are of a type which have an appreciable number of appendages underwater. These appendages do little more than to produce vastly increased drag. Further, if care is not taken, negative drag can occur which if unchecked can force the rudder into a full turn position.

Accordingly, it is a further object of this invention to provide an integrated drive-steering system with improved flanking type rudders which have minimum drag and facilitate effective steering.

SUMMARY OF THE INVENTION

In accordance with a preferred embodiment of this invention a shroud for a boat propeller is adapted to be mounted on the rear transom of a boat. The shroud is configured to be semi-circular in shape, to encompass at least the upper portion of the propeller, and extend forwardly of the propeller to the transom and somewhat rearwardly of the propeller. The axis of the propeller is oriented to extend through the planing center of resistance of the hull. This provides a more stable ride. In addition, the lower side portions of the shroud are skirts whose lower edges lie in a plane which are parallel to the keel of the boat. This facilitates design of a boat having a relatively shallow draft with reduced cavitation of the propeller and minimum appendage losses.

The shroud substantially conforms to the bottom contour of the hull at the front portion thereof and rises to shroud less than 50% of the periphery of the propeller at the rear portion thereof. The contour of the shroud is such that the intersections of the inner wall of the shroud with planes parallel to a vertical plane through the axis of the propellers are straight lines, thereby to reduce the turbulence in the water flowing through the shroud. In a preferred embodiment the axis of the propeller forms about an 8° angle with the hull.

Flanking rudders are mounted by a yoke pivoted on the upper portion of the shroud about a vertical axis intersecting the spin axis of the propeller. The flanking rudders are secured to either end of the yoke on opposite sides of the shroud. The center of area of the rudders is about in the plane of revolution of the propeller and the yoke is pivoted ahead of the center of area of the rudders whereby either rudder is permitted to swing behind the propeller without the alternate rudder impeding the flow to the propeller.

In accordance with another embodiment of the invention, a horizontally disposed planing plate having substantially the same contour as the shroud is pivotally secured to the rear portion of the shroud to pivot in a vertical plane. This permits adjustments of the thrust direction to be made to correct for improper hull loading.

BRIEF DESCRIPTION OF THE DRAWINGS

The invention, both as to its organization and method of operation, as well as additional objects and advantages thereof, will be further understood from the following description when read in connection with the accompanying drawings which are not limitative and in which.

BRIEF DESCRIPTION OF THE PREFERRED EMBODIMENT

Figures 1, 2, 8, 9:
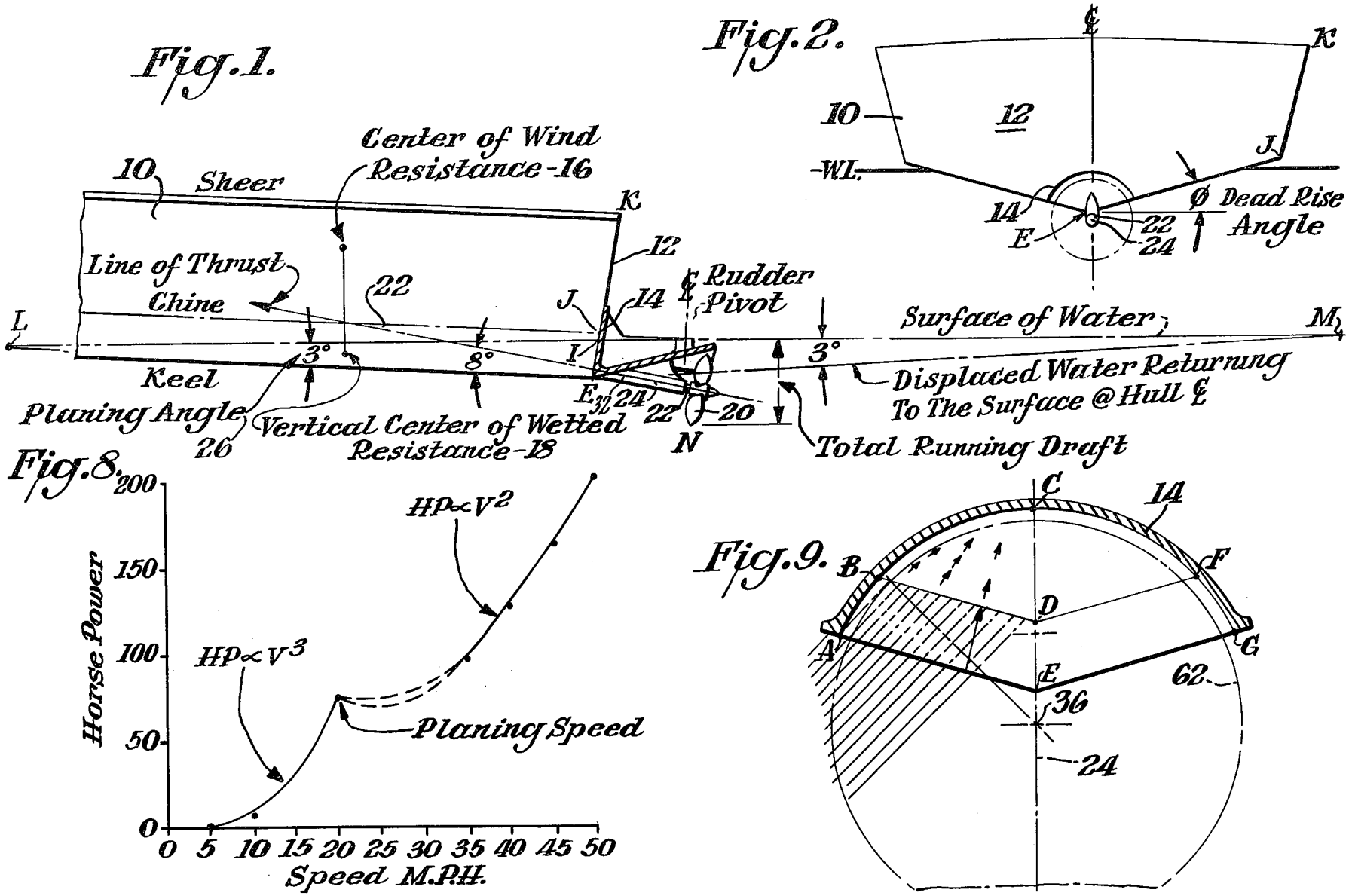
FIG. 1 is a side elevation view, partly in cross-section of a shroud positioned on the transom of the boat with the aft half of a boat shown, in accordance with a preferred embodiment of this invention.
FIG. 2 is a stern view of the shroud depicted in FIG. 1, depicting particularly a boat having a V-bottom.
FIG. 8 is a plot of demand horsepower versus boat speed for a typical planing boat.
FIG. 9 is a cross-sectional view of a shroud taken through a section lying in the plane of the propeller depicting the water flow characteristics within the shroud of this invention by which cavitation of the propeller is reduced with a propeller located close to the surface of the water.
Figure 4:
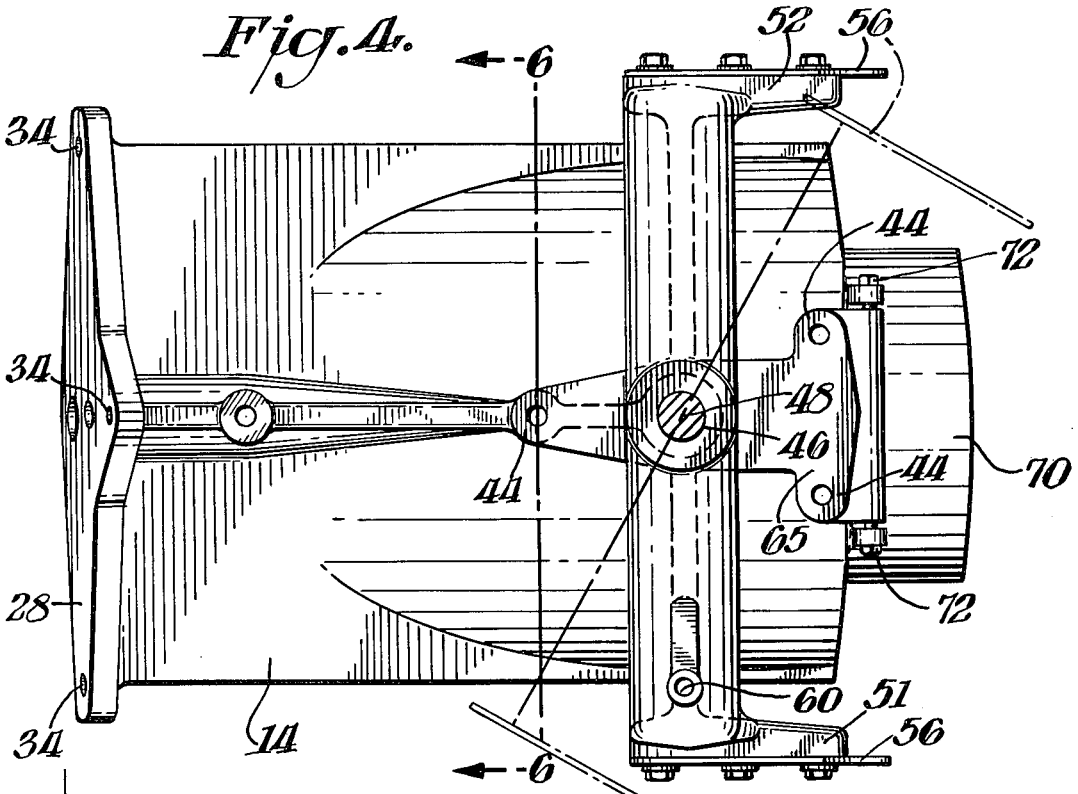
FIG. 4 is a plan view of a shroud depicted in FIG. 3.
Figure 3:
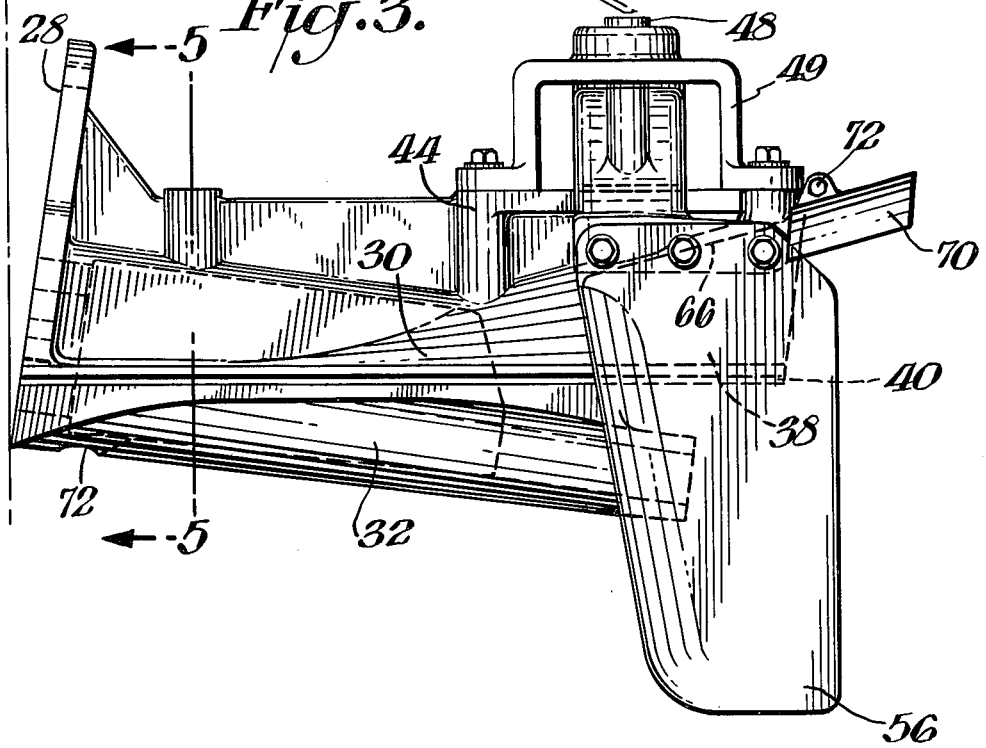
FIG. 3 is a side elevation view of the shroud illustrated in FIG. 1 somewhat enlarged.
Figure 7:
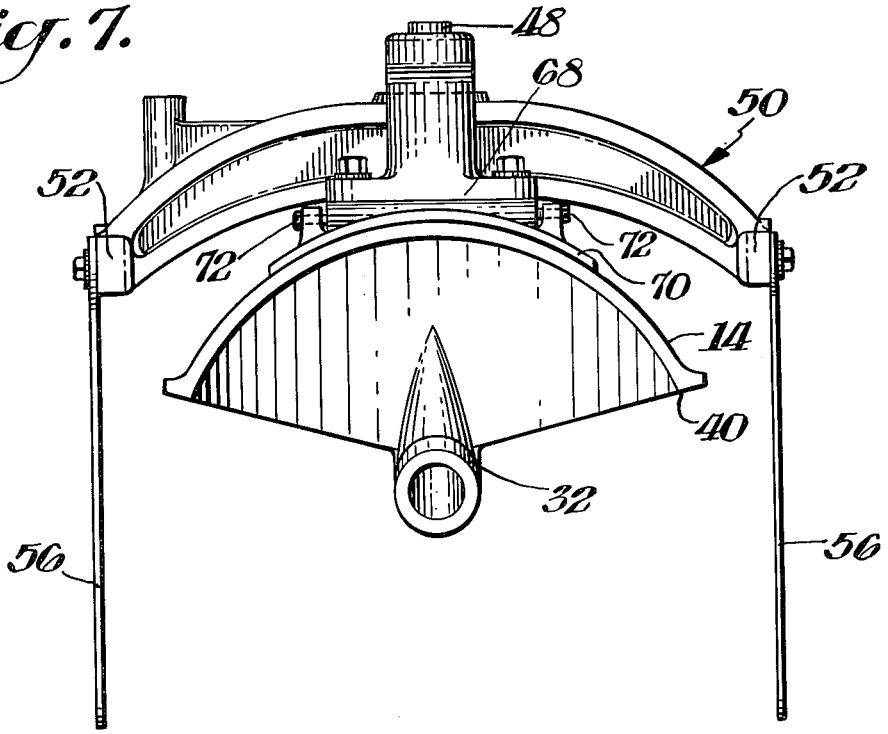
FIG. 7 is an end elevation view of a shroud depicted in FIG. 3 particularly illustrating the yoke mounted flanking rudders.
Figure 6:
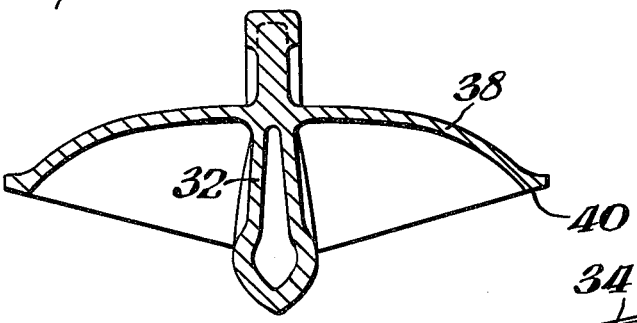
FIG. 6 is a cross-sectional view of the shroud depicted in FIG. 3 taken along the section line 6—6.
Figure 5:
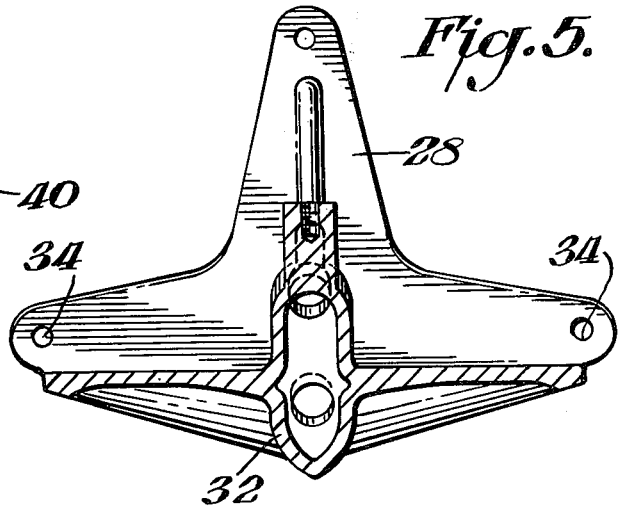
FIG. 5 is a cross-sectional view of the shroud depicted in FIG. 3 taken along the section line 5—5.

There may be seen, with particular reference to FIGS. 1 and 2, the manner in which a shroud constructed in accordance with this invention is positioned on the rear transom of a typical boat to provide an improved propulsion system. This propulsion system is capable of operation at both high and low speeds under both planing and non-planing conditions. It is sufficiently versatile to be adaptable to virtually any boat. When used, it permits the propeller shaft to be inserted through the rear transom to permit shallow draft operation and a high degree of versatility in the mounting of the boat engine. This is particularly true since the thrust bearing for the propeller drive shaft may be mounted in or about the transom itself. To permit versatility of the mounting, the drive shaft may be coupled through two universal joints to the actual power plant within the boat. The propeller shaft, preferably, extends through the lower portion of the transom at an angle of approximately 8° with the fore and aft line of the keel and projects beyond the transom preferably one and one-half to three times the propeller diameter. It may have greater or lesser angles or extension distances, but lesser angles or distances tend to keep the propeller more above the water line with greater danger of cavitation and greater angle distances tend to increase the draft of the boat.

This may be seen most clearly with reference to FIGS. 1 and 2 wherein a typical boat 10 having a V hull is depicted. The boat has a transom 12 to which is mounted the anti-cavitation shroud 14 of this invention. The boat itself has a center of wind resistance 16 and a center of wetted resistance 18. In accordance with this invention the axis of the propeller drive shaft is oriented so as to lie between these two points and preferably upon the center of the resistance of the entire boat which of course will vary with boat design, but in any event lies at the centroid of the two resistance points 16 and 18. To this end an approximation is made that is most desirable for typical operating conditions (since both points will vary) of the boat in question.

Under typical planing conditions, the angle of attack 26 of the boat relative to the water is approximately 3° as seen in FIG. 1. As will be described, the propeller is positioned such that, in a preferred ambodiment, it is not quite all submerged under typical planing conditions of the boat (typically it may be about 84% submerged).

The shroud itself together with its flanking rudder yoke is best understood by reference to FIGS. 3 through 7. As may be seen in these figures, the shroud 14 includes a mounting plate 28 which is adapted to be bolted to the transom 12 (FIG. 1) of the boat. Formed integrally with the mounting plate 28 is a developed shape housing 30, generally semi-circular or arcuate in transverse cross-section, which includes a downwardly extending body 32 which provides a support for a suitable front and rear bearing (not shown) for the propeller shaft 22. This housing 30 gradually expands as a function of its distance in the aft direction of the boat to provide a gradually expanding funnel-like configuration such that at the rear most portions, which correspond approximately with the periphery of the propeller in the propeller spin plane, the section has a contour which just provides a clearance for the propeller blades. Its arcuate length is such that it shrouds less than 50% of the propeller and preferably for a planing boat, about 37% of the propeller. The mounting plate 28 may be bolted to the transom by suitable bolts passed through bore 34. Additional orifices 36 may be provided for purposes as will be described. The downwardly extending body 32, which provides the support for the front and rear bearings for mounting the propeller shaft 22, forms a cavity through which the propeller shaft extends.

The semi-circular section in the propeller spin plane has downwardly extending skirt portions 38 whose lower edges 40 lie in a plane which lies in a plane parallel to the keel of the boat. This requirement is the limiting factor which determines how much of the propeller is shrouded. The crest 42 of the shroud 14 has a protuberance 44 in which is provided a bore 46 adapted to house a pin 48 which mounts a yoke member 50. An upper bracket 49 supports the upper end of the pin 48 and is bolted to the shroud to complete the rudder mounting assembly. The yoke member 50 is arcuate in shape with its depending end portions 51 extending downwardly so as to provide flat end plates 52, which have suitable bores formed therein to accommodate bolts which are used to mount flanking rudders 56. The particular position of the pin 48 preferably is forward of the spin plane or plane of revolution of the propeller. In this connection it should be noted that the depending end portions 51 of the yoke 50 trail aft or backward of the pivot point so that the rudders may be mounted with their center of area substantially in line of the plane of revolution of the propeller. In this manner when the yoke 50 is rotated (FIG. 4), one rudder will swing forwardly until it encounters the skirt portions of the shroud whereas the remaining rudder will swing behind the thrust region of the propeller such that, particularly at low speeds, it will have a high degree of effect upon the steering of the boat and yet will not be within the forward flow pattern of the propeller and thereby create unwanted drag. A bore 60 may be provided within the yoke 50 such that a pivot pin may be tapped thereto to provide a mounting point for a linkage for turning the yoke and, hence, the rudders from within the boat. This linkage may be rigid or otherwise as desired.

The rudders 56 may be rectangular in shape wherein their downwardly extending dimension exceeds the lateral or horizontal dimension.

The shroud itself may be configured so that planes taken through the inner surface 66 of the shroud substantially parallel to a vertical plane passing through the center line 36 of the propeller shaft 22 will form substantially straight lines. The reasons for this will become apparent in the subsequent discussion. Suffice it to say for the moment that such straight lines create minimum turbulence in the water as it passes through this section.

At the rear portion of the shroud, there is provided a mounting boss 68 to which may be mounted a planing plate 70. The plate 70 may have an arcuate configuration corresponding to that of the shroud and extend rearwardly of the shroud for a distance corresponding to approximately one-fourth of the longitudinal length of the shroud itself. This planing plate may be pivotally mounted as by pins 72 so as to be pivotable within a vertical plane for the purpose of redirecting the thrust by the propeller downwardly.

The center section 32 of the shroud is hollow so as to provide a conduit if desired for the intake of water from opening 72 for cooling the engine and lubricating the propeller shaft bearing.

The operation of the shroud and flanking rudders may be best understood with the particular reference to FIG. 9 in conjunction with FIG. 1. It may be noted from these figures, that, with the particular attack angle of the boat assumed at 3° as illustrated, the lower edge of the skirt of the shroud lies in a plane parallel with the keel of the boat. The planing boat forms or generates an apparent water line length L. M. The displaced water rises behind the hull to the surface in nearly a straight line, and has a length which is proportional to the boat's speed. With typical hull forms and approximate speeds of 40 m.p.h. assumed in this illustration, the length of the rise is approximately equal to the hull water line length. Under these conditions, as the water leaves the hull as exemplified by the region AEG, it rises rapidly in a plane to the plane BDF at the end of the shroud. In this particular illustration, the center line of the propeller rotation 36 swings the propeller in an arc defined by the line 62. The area defined by the rising plane of water BDF under these conditions would provide 83% of the swept area of the propeller with solid water.

As this rising flow in the shroud in impinging upon a cross-section which is diminishing, i.e., AE is greater than BD, further lift to fill the remaining 17% area in the top of the shroud is generated. Since the velocity head is increased, the pressure head in the top of the shroud is decreased according to the well known Bernoulli theorem. This shroud can also be considered as part of a divergent orifice in which the flowing water tends to flow in contact with the wall since the water adhesion to solids is greater than the water cohesion to itself. However, the major influence on lifting of the water to fill the region BDFC is the suction created by the propeller itself since the velocity is increased and the pressure head reduced as the propeller accelerates the water passing it.

A brief reference to FIG. 2 reveals a typical horsepower versus speed curve of a planing type boat. As shown in this graphical presentation, planing occurs at 20 m.p.h. and roughly 75 horsepower. The dotted section shows that just after planing is accomplished, the speed of the boat can increase with no increase in power and even a reduction in power in some cases.

At lower speeds (non-planing) the boat behaves as a displacement vessel and demand horsepower power is proportional to the cube of the speed ($HP \alpha V^3$). Once planing has been fully established, the demand horsepower is proportional to the square of the velocity ($HP \alpha V^2$). Of course, these exponents have a tolerance depending upon hull design, drive design and power to weight ratios. It is important to note, however, that up to the point of planing the attack angle or angle of incidence is greater than the planing angle and the boat is running lower in the water and runs with more draft as the dynamic force generated at speeds sufficient to lift the hull have not been fully established. Under these conditions, the propeller is fully immersed, i.e., the shroud is filled, and full thrust can be developed by the propeller to drive the boat into a planing condition or attitude.

Up to the point of planing, it is, therefore, evident that greater propeller speeds are required in proportion to boat speed to generate the necessary horsepower. Since cavitation can develop under these conditions, it is to be noted that the shroud reduces the possibility of air being drawn into the propeller race from the surface of the water. It is to be noted also that the rudder is not positioned in the wash of the propeller. For this reason, it creates less drag than is normal and yet at low speeds, it is so positioned that one rudder blade may be positioned directly behind the thrust of the propeller to provide excellent control over turning. The use of the planing plate having the same curvature as the shroud creates little additional drag loss in the particular flowing water. The advantage of this planing plate adjustment is that the thrust direction of the water flowing from the propeller may be modified to some extent so as to change the attitude of the boat on the water.

In the reverse mode of operation, part of the propeller wash is deflected downwardly and under the hull thus providing some lift to the stern to minimize digging-in.

The arrangement just described affords great versatility in mounting the engine. The engine may be mounted within the boat and coupled to the propeller shaft through universal joints so as to be almost completely vibration isolated therefrom. The universal joints (not shown) afford complete freedom of location of the engine. The thrust bearing from the propeller itself may be mounted within the transom or immediately within the boat side of the transom so as to reduce the number of fittings requiring water seals that must be used. Since the propeller shaft has an axis which is relatively close to that of the keel, relatively shallow draft of the boat is achieved and a particular advantage results if the axis of the propeller is directed to the center of resistance of the hull. This affords more stable riding conditions of the boat. A slot in hollow body 32 may be used as a water intake for the engine, and provide lubrication for the rear bearing.

It is to be noted further that the application of this invention is not limited to a typical V-shaped hull. On the contrary, it may be used with virtually any type of hull such as the inverted V, flat or round bottom. Separate anti-cavitation shrouds designed according to this invention may be placed on either side of a V-shaped bottom if twin engines are desired.

It is obvious that many embodiments may be made of this inventive concept, and that many modifications may be made in the embodiment hereinbefore described. Therefore, it is to be understood that all descriptive material herein is to be interpreted merely as illustrative, exemplary and not in a limited sense. It is intended that various modifications which might readily suggest themselves to those skilled in the art be covered by the following claims as far as the prior art permits.

What is claimed is:

1. A shroud adapted to be mounted at the rear transom of a boat having a propeller, said propeller defining a propeller disc and a plane of revolution, a propeller shaft extending through said transom, a keel, and a hull having a planing center of resistance; said shroud extending rearwardly of said boat and being of expanding arcuate shape encompassing only the upper portion of said propeller disc and extending forwardly of said plane of revolution to said transom and rearwardly of said plane of revolution.

2. An apparatus according to claim 1 wherein the axis of said propeller shaft extends about through the planing center of resistance of said hull.

3. Apparatus according to claim 2 wherein said shroud has depending skirts whose lower edges lie in a plane parallel to said keel.

4. An apparatus according to claim 3 wherein said shroud substantially conforms to the transverse bottom contour of said hull at the front portion thereof and rises to shroud less than 50% of the periphery of said propeller at the rear portion thereof.

5. An apparatus according to claim 4 wherein said shroud has an innerwall whose intersections with planes parallel to a vertical plane through the axis of said propeller shaft are straight lines, thereby to reduce turbulence in water.

6. An apparatus according to claim 5 wherein the axis of the propeller shaft forms about an 8° angle with said hull's keel.

7. An apparatus according to claim 6 wherein said shroud has a rear portion which encompasses about 3% of the periphery of said propeller.

8. An apparatus according to claim 5 wherein said shroud has an upper portion and which also includes a yoke pivoted on the upper portion of said shroud about a vertical axis intersecting the axis of said propeller shaft, a pair of aft flanking rudders secured to either end of said yoke on opposite sides of said shroud, and means to manipulate said yoke.

9. An apparatus according to claim 8 wherein the center of area of said rudders is aft of the plane of revolution of said propeller.

10. An apparatus according to claim 9 wherein said yoke is pivoted ahead of the center of area of said rudders, whereby either rudder is permitted to swing behind said propeller without the other rudder impeding flow to said propeller.

11. An apparatus according to claim 10 which also includes a horizontally disposed planing plate having substantially the same contour as the rear contour of said shroud and pivotally secured to the rear portion of said shroud to pivot in a vertical plane, and means to adjust the position of said plate.

12. An apparatus according to claim 1 wherein said shroud has depending skirts whose lower edges lie in a plane parallel to said keel.

13. An apparatus according to claim 1 wherein said shroud substantially conforms to the bottom contour of said hull at the front portion thereof and rises to shroud about 37% of the periphery of said propeller at the rear portion thereof.

14. An apparatus according to claim 13 wherein said shroud has an innerwall whose intersections with planes parallel to a vertical plane through the axis of said propeller shaft are straight lines, thereby to reduce turbulence in water.

15. An apparatus according to claim 1 wherein said shroud has an upper portion and which also includes a yoke pivoted on the upper portion of said shroud about a vertical axis intersecting the axis of said propeller shaft, a pair of aft flanking rudders secured to either end of said yoke on opposite sides of said shroud, and means to manipulate said yoke.

16. An apparatus according to claim 15 wherein the center of areas of said rudders is aft of the plane of revolution of said propeller.

17. An apparatus according to claim 15 wherein said yoke is pivoted ahead of the center of area of said rudders, whereby either rudder is permitted to swing behind said propeller without the other rudder impeding flow to said propeller.

18. An apparatus according to claim 1 which also includes a horizontally disposed planing plate having substantially the same contour as said shroud and pivotally secured to the rear portion of said shroud to pivot in a vertical plane, and means to adjust the position of said plate.

19. An apparatus according to claim 8 which also includes a horizontally disposed planing plate having substantially the same contour as said shroud and pivotally secured to the rear portion of said shroud to pivot in a vertical plane, and means to adjust the position of said plate.

* * * * *

UNITED STATES PATENT OFFICE

CERTIFICATE OF CORRECTION

PATENT NO. : 4,031,846

DATED : June 28, 1977

INVENTOR(S) : John W. Tone

It is certified that error appears in the above-identified patent and that said Letters Patent are hereby corrected as shown below:

In Claim 7, line 2, change "3%" to ---37%---.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*